US011331908B2

(12) United States Patent
Sato et al.

(10) Patent No.: US 11,331,908 B2
(45) Date of Patent: May 17, 2022

(54) LIQUID EJECTION HEAD UNIT AND LIQUID EJECTING APPARATUS

(71) Applicant: SEIKO EPSON CORPORATION, Tokyo (JP)

(72) Inventors: Tatsuya Sato, Nagano (JP); Shuichi Nakano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/082,068

(22) Filed: Oct. 28, 2020

(65) Prior Publication Data

US 2021/0129526 A1 May 6, 2021

(30) Foreign Application Priority Data

Oct. 30, 2019 (JP) ..... JP2019-197195

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC ..... B41J 2/365; B41J 2/17546; B41J 2/04581
See application file for complete search history.

(56) References Cited

U.S. PATENT DOCUMENTS 5,890,819 A * 4/1999 Compton ..... B41J 2/365 400/120.12
2006/0290756 A1* 12/2006 Hatasa ..... B41J 2/17546 347/86

FOREIGN PATENT DOCUMENTS

JP 2010-052166 A 3/2010

* cited by examiner

*Primary Examiner* — Lam S Nguyen
(74) *Attorney, Agent, or Firm* — Global IP Counselors, LLP

(57) ABSTRACT

A liquid ejection head unit includes an ejection unit that ejects a liquid, a first wire configured to supply a fixed potential used for driving the ejection unit, a second wire configured to transmit a pulse signal that defines an ejection timing of the liquid in the ejection unit, a first counter whose count value changes based on a potential change in the first wire, a second counter whose count value changes based on a potential change in the second wire, and an ejection restriction unit that restricts an ejection operation of the liquid in the ejection unit according to a count value of the first counter and a count value of the second counter.

14 Claims, 11 Drawing Sheets

LIQUID EJECTION HEAD UNIT AND LIQUID EJECTING APPARATUS

The present application is based on, and claims priority from JP Application Serial Number 2019-197195, filed Oct. 30, 2019, the disclosure of which is hereby incorporated by reference herein in its entirety.

BACKGROUND

1. Technical Field

The present disclosure relates to a liquid ejection head unit and a liquid ejecting apparatus.

2. Related Art

In the related art, a liquid ejecting apparatus that ejects a liquid such as ink is known, as represented by an ink jet printer. This type of apparatus has a liquid ejection head unit including a liquid ejection head that ejects a liquid, as disclosed in, for example, JP-A-2010-52166. The liquid ejection head unit is electrically coupled to a substrate mounted on the apparatus main body via a cable such as a flexible flat cable.

Such a cable has a risk of damage such as a break of a wire due to deterioration over time. Specifically, when the carriage reciprocates with respect to the apparatus main body as in JP-A-2010-52166, since the cable is repeatedly deformed with the reciprocating movement, a risk of the wire damage increases. Therefore, the apparatus described in JP-A-2010-52166 detects, based on the voltage value of a wire provided on the cable, the damage of the wire.

However, in the apparatus described in JP-A-2010-52166, the determination for detecting the damage of the wire is based only on the voltage value of the wire, so that when the apparatus is used in an environment where the voltage value of the commercial power supply fluctuates, such as in emerging countries, the damage of the wire may be erroneously detected due to the influence of the fluctuation of the voltage value. For this reason, the apparatus described in JP-A-2010-52166 has a problem in that the apparatus operation is unnecessarily restricted based on the false detection, resulting in lack of usability.

SUMMARY

According to an aspect of the present disclosure, a liquid ejection head unit includes an ejection unit that ejects a liquid, a first wire configured to supply a fixed potential used for driving the ejection unit, a second wire configured to transmit a pulse signal that defines an ejection timing of the liquid in the ejection unit, a first counter whose count value changes based on a potential change in the first wire, a second counter whose count value changes based on a potential change in the second wire, and an ejection restriction unit that restricts an ejection operation of the liquid in the ejection unit based on a count value of the first counter and a count value of the second counter.

According to another aspect of the present disclosure, a liquid ejecting apparatus includes an ejection unit that ejects a liquid, a first wire configured to supply a fixed potential used for driving the ejection unit, a power supply circuit that supplies the fixed potential to the first wire using electric power supplied from a commercial power supply, a second wire configured to transmit a pulse signal that defines an ejection timing of the liquid in the ejection unit, a first counter whose count value changes according to a potential change in the first wire, a second counter whose count value changes according to a potential change in the second wire, and an ejection restriction unit that restricts an ejection operation of the liquid in the ejection unit according to a count value of the first counter and a count value of the second counter.

DESCRIPTION OF EXEMPLARY EMBODIMENTS

Hereinafter, embodiments for carrying out the present disclosure will be described with reference to the drawings. However, in each figure, the size and scale of each component are appropriately changed from the actual ones. In addition, since the embodiments described below are preferable specific examples of the present disclosure, there are various technically preferred limitations. However, the scope of the present disclosure is not limited to these embodiments unless otherwise specified in the following description.

A1. First Embodiment

A1-1. Overview of Liquid Ejecting Apparatus 1

Figure 1:
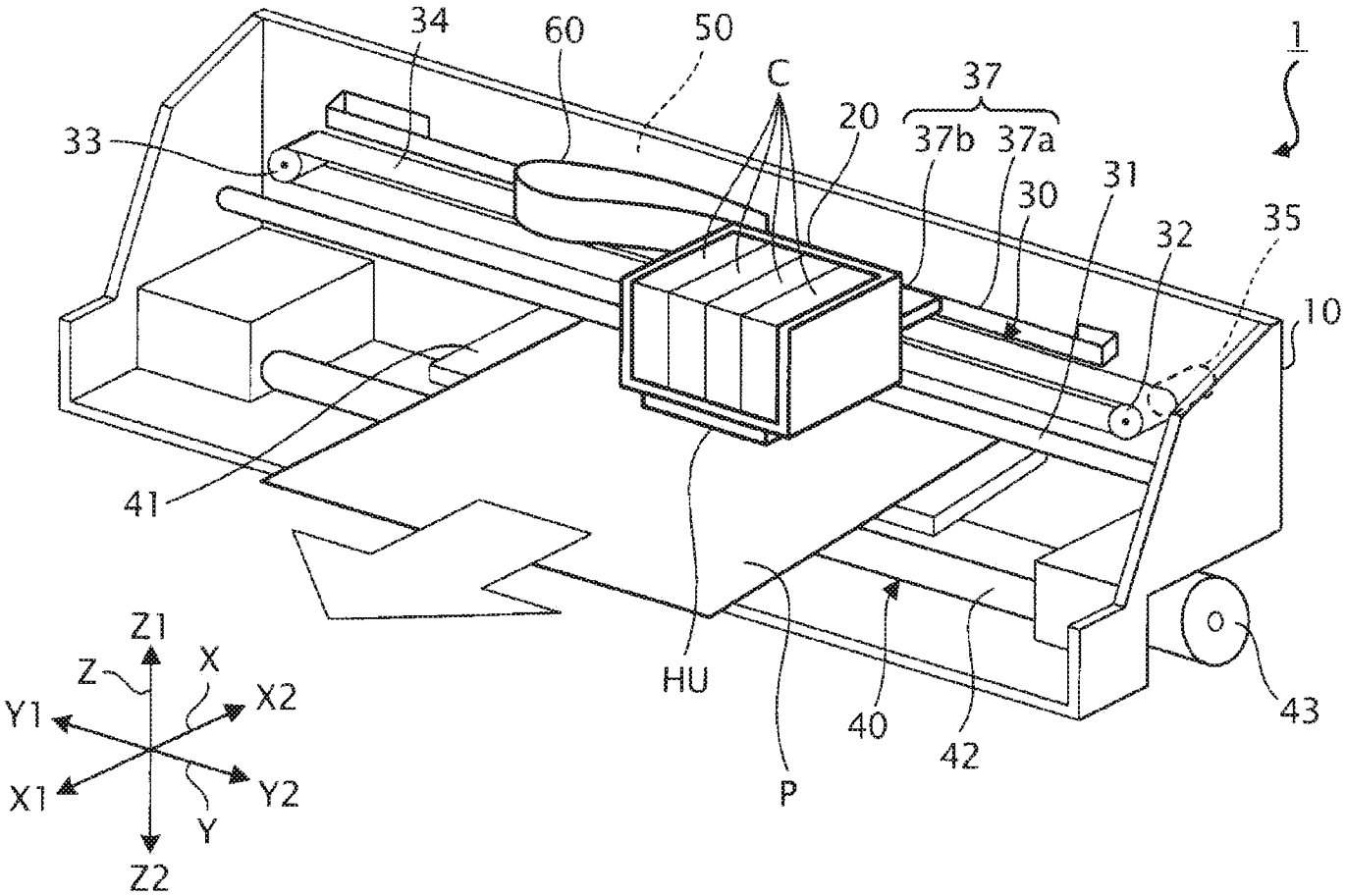
FIG. 1 is a perspective view showing a schematic configuration of a liquid ejecting apparatus according to a first embodiment.

FIG. 1 is a perspective view showing a schematic configuration of a liquid ejecting apparatus 1 according to an embodiment. The liquid ejecting apparatus 1 is an ink jet printer that performs printing by ejecting ink, which is an example of a liquid, as droplets toward a print medium P. A typical example of the print medium P is print paper. However, the print medium P is not limited to printing paper, and may be a printing target made of any material such as a resin film or fabric cloth.

In the example shown in FIG. 1, the liquid ejecting apparatus 1 is a serial printer. Specifically, as shown in FIG. 1, the liquid ejecting apparatus 1 includes a housing 10, a carriage 20, a movement mechanism 30, a transport mechanism 40, and a control module 50.

In the liquid ejecting apparatus 1, print data is supplied to the control module 50 from a host computer (not shown) which is an external device such as a personal computer or a digital camera. Under the control of the control module 50, while the transport mechanism 40 transports the print medium P in the sub scanning direction, and the movement mechanism 30 reciprocates the carriage 20 in the main scanning direction, a head unit HU mounted on the carriage 20 ejects ink toward the print medium P. At this time, the control module 50 controls the operation of the head unit HU based on the print data, so that the image corresponding to the print data is printed on the print medium P.

Hereinafter, first, the structure of respective components in the liquid ejecting apparatus 1 will be briefly described with reference to FIG. 1. In the following, for convenience of description, the description will be given by appropriately using X axis, Y axis, and Z axis orthogonal to each other. Further, one direction along the X axis is referred to as the X1 direction, and a direction opposite to the X1 direction is referred to as the X2 direction. Similarly, one direction along the Y axis is referred to as the Y1 direction, and a direction opposite to the Y1 direction is referred to as the Y2 direction. One direction along the Z axis is referred to as the Z1 direction, and a direction opposite to the Z1 direction is referred to as the Z2 direction. In the present embodiment, one or both of the Y1 direction and the Y2 direction is the main scanning direction described above, and the X1 direction is the sub scanning direction described above. However, the X axis, the Y axis, and the Z axis are not limited to being orthogonal to each other, and may intersect with each other within a range in which the operation of the liquid ejecting apparatus 1 is not adversely affected.

The housing 10 is a structure that supports the movement mechanism 30 and the transport mechanism 40.

The movement mechanism 30 is a mechanism that causes the carriage 20 to reciprocate in the Y1 direction and the Y2 direction with respect to the housing 10. Specifically, the movement mechanism 30 includes a guide shaft 31, a pair of pulleys 32 and 33, a timing belt 34, a motor 35, and an encoder 37.

The guide shaft 31 is fixed to the housing 10, includes a rod shape extending along the Y axis, and movably supports the carriage 20 along the Y axis. The pulley 32 is rotationally driven by the motor 35. The pulley 33 drivenly rotate by the driving force transmitted from the pulley 32 via the timing belt 34. The timing belt 34 has an endless shape and is spanned between the pair of pulleys 32 and 33 in a state of extending along the guide shaft 31. The carriage 20 is fixed to part of the timing belt 34 in the circumferential direction.

The encoder 37 is a transmissive linear encoder that detects the position of the carriage 20 in the Y1 direction or the Y2 direction. The encoder 37 includes a scale 37*a* and an optical sensor 37*b*. The scale 37*a* is a band-shaped light-transmissive member that is fixed to the housing 10 and is disposed along the Y axis. Although not shown, the scale 37*a* has a plurality of light-shielding patterns disposed at predetermined intervals along the longitudinal direction by printing or the like. The optical sensor 37*b* is fixed to the carriage 20 to output a signal according to a change in relative position with respect to the scale 37*a*. Although not shown, the optical sensor 37*b* includes a light emitting element that emits light toward the scale 37*a*, and a light receiving element that receives the light transmitted from the light emitting element through the scale 37*a*. The encoder 37 only needs to be able to detect the position of the carriage 20 in the Y1 direction or the Y2 direction. The configuration is not limited to that shown in FIG. 1, and for example, a reflective linear encoder may be used.

In the above movement mechanism 30, when alternately switching the rotation of the motor 35 between the forward direction and the reverse direction, the carriage 20 reciprocates along the guide shaft 31 in the Y1 direction and the Y2 direction by the driving force transmitted from the motor 35 to the carriage 20 via the timing belt 34. In addition, the output of the encoder 37 is input to the control module 50 and is appropriately used for controlling respective components of the liquid ejecting apparatus 1.

The transport mechanism 40 is a mechanism that transports the print medium P in the X1 direction with respect to the housing 10. Specifically, the transport mechanism 40 includes a platen 41, a transport roller 42, and a motor 43. The platen 41 is a plate-shaped base that supports the print medium P to which ink is applied from the head unit HU. The print media P are fed onto the platen 41 one by one by a feeding roller (not shown). The transport roller 42 is rotationally driven by the motor 43 and transports the print medium P on the platen 41 in the X1 direction.

The relative position of the carriage 20 with respect to the print medium P is changed in both the direction along the X axis and the direction along the Y axis by the cooperation of the movement mechanism 30 and the transport mechanism 40 described above. The head unit HU and a plurality of ink cartridges C are mounted on the carriage 20.

Each of the plurality of ink cartridges C stores the ink supplied to the head unit HU. The types of ink stored in the plurality of ink cartridges C are different from each other. In the example shown in FIG. 1, the number of ink cartridges C is four, and the colors of ink stored in the four ink cartridges C are different from each other. Examples of the colors of ink stored in the four ink cartridges C include four colors of cyan, magenta, yellow, and black. The plurality of ink cartridges C may be attached to the housing 10 instead of being mounted on the carriage 20. In this case, for example, the ink may be supplied to the head unit HU from the plurality of ink cartridges C via tubes. Further, the number of the ink cartridges C included in the head unit HU may be three or less or five or more.

The head unit HU ejects the ink from the plurality of ink cartridges C as droplets toward the print medium P. In the example shown in FIG. 1, the head unit HU receives the four color inks from the four ink cartridges C described above, and ejects the four color inks.

The carriage 20 described above is electrically coupled to the control module 50 via a cable 60. In the example shown in FIG. 1, the cable 60 is a flexible flat cable. The cable 60 is not limited to a flexible flat cable, and may be a flexible wiring substrate, for example.

A1-2. Electrical Configuration of Liquid Ejecting Apparatus 1

Figure 2:
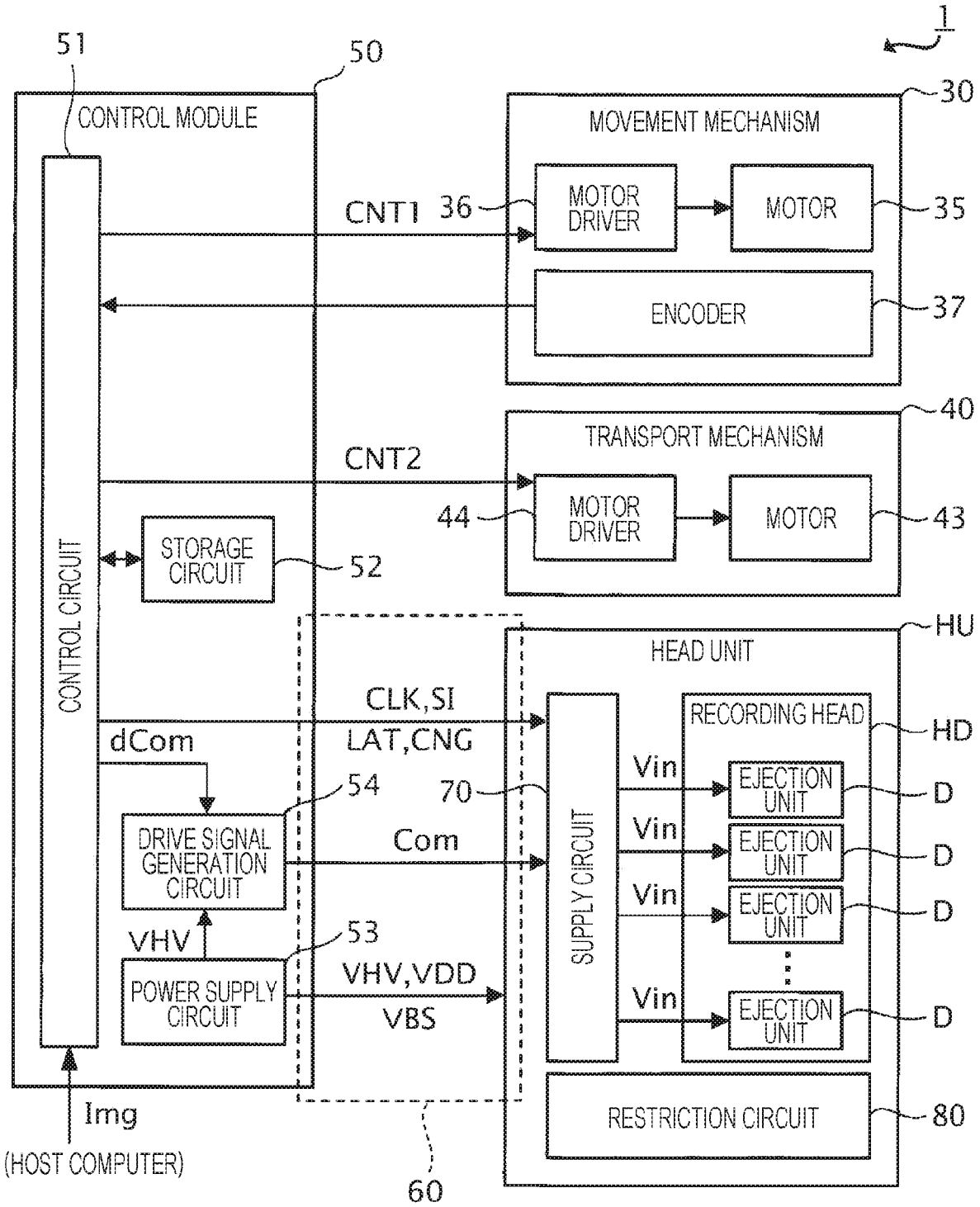
FIG. 2 is a block diagram showing an electrical configuration of the liquid ejecting apparatus according to the first embodiment.

FIG. 2 is a block diagram showing an electrical configuration of the liquid ejecting apparatus 1 according to a first embodiment. As shown in FIG. 2, the movement mechanism 30 includes a motor driver 36 that drives the above-described motor 35, in addition to the above-described components. The transport mechanism 40 includes a motor driver 44 that drives the above-described motor 43, in addition to the above-described components. The control module 50 may include part or all of the motor driver 36 or 44.

The head unit HU includes a recording head HD, a supply circuit 70, and a restriction circuit 80. The recording head HD includes a plurality of ejection units D that eject ink. The supply circuit 70 supplies a supply drive signal Vin that drives the ejection units D to one or more ejection units D selected from the plurality of ejection units D. The restriction circuit 80 restricts the ejection of ink from the recording head HD when the damage to the wire of the cable 60 is detected. The recording head HD, the cable 60, the supply circuit 70, and the restriction circuit 80 described above will be described in detail later.

In the example shown in FIG. 2, although the number of recording heads HD included in the head unit HU is one, the number is not limited to this. The number of recording heads HD included in the head unit HU may be two or more. Further, the number of the ejection units D included in the recording head HD may be one. In the following description, when the number of the ejection units D of the recording head HD is M, in order to distinguish the M respective ejection units D, the ejection unit D may be referred to as the ejection unit D[m] using the subscript [m]. Each of M and N is a natural number of 1 or more. Further, the subscript [m] may be used to indicate the corresponding relationship with the ejection unit D[m] for M other components or signals in the liquid ejecting apparatus 1.

The control module 50 is a circuit that controls the driving of each of the movement mechanism 30, the transport mechanism 40, and the head unit HU described above. Specifically, the control module 50 includes a control circuit 51, a storage circuit 52, a power supply circuit 53, and a drive signal generation circuit 54.

The control circuit 51 has a function of controlling the operations of respective components of the liquid ejecting apparatus 1 and a function of processing various pieces of data. The control circuit 51 includes a processor such as at least one a central processing unit (CPU). Instead of a CPU, or in addition to the CPU, the control circuit 51 may include a programmable logic device such as a field-programmable gate array (FPGA).

The storage circuit 52 stores various programs executed by the control circuit 51 and various pieces of data such as print data Img processed by the control circuit 51. The storage circuit 52 includes a semiconductor memory of one or both of, for example, a volatile memory such as a random access memory (RAM) and a nonvolatile memory such as a read only memory (ROM), an electrically erasable programmable read-only memory (EEPROM), or a programmable read only memory (PROM). The print data Img is supplied from a host computer which is an external device such as a personal computer or a digital camera (not shown).

The power supply circuit 53 is supplied with power from a commercial power supply (not shown) and generates various predetermined potentials. Specifically, the power supply circuit 53 generates a high-potential-side power supply potential VHV, a low-potential-side power supply potential VDD, and an offset potential VBS. As set values of these potentials, for example, the power supply potential VHV is about 42 V, the power supply potential VDD is about 3.3 V, and the offset potential VBS is about 6 V. These potentials are supplied to the head unit HU via the cable 60. Here, the power supply potential VHV is an example of a "fixed potential" supplied to a first wire included in the cable 60. The power supply potential VHV is also supplied to the drive signal generation circuit 54. Although not shown, the head unit HU is also supplied with a reference potential of 0 V, which is a reference for the above-described potentials, via the cable 60.

The drive signal generation circuit 54 is a circuit that generates a drive signal Com for driving the ejection unit D. Specifically, the drive signal generation circuit 54 includes, for example, a DA conversion circuit and an amplifier circuit. In the drive signal generation circuit 54, the DA conversion circuit converts a waveform designation signal dCom from the control circuit 51 from a digital signal to an analog signal, and the amplifier circuit amplifies the analog signal using the power supply potential VHV from the power supply circuit 53 to generate the drive signal Com. Here, among the waveforms included in the drive signal Com, the signal of the waveform that is actually supplied to the ejection unit D is the above-mentioned supply drive signal Vin. The waveform designation signal dCom is a digital signal for defining the waveform of the drive signal Com.

The control circuit 51 has a function of controlling the operations of respective components of the liquid ejecting apparatus 1 by executing a program stored in the storage circuit 52. Specifically, the control circuit 51 executes the program to generates, as a signal for controlling the operation of each component of the liquid ejecting apparatus 1, a control signals CNT1 and CNT2, a print signal SI, the waveform designation signal dCom, a clock signal CLK, a latch signal LAT, and a change signal CNG. Here, the latch signal LAT is an example of a "pulse signal" transmitted to a second wire included in the cable 60.

The control signal CNT1 is a signal for controlling the driving of the movement mechanism 30. The control signal CNT1 is supplied to the motor driver 36 of the movement mechanism 30. The motor driver 36 drives the motor 35 according to the control signal CNT1.

The control signal CNT2 is a signal for controlling the driving of the transport mechanism 40. The control signal CNT2 is supplied to the motor driver 44 of the transport mechanism 40. The motor driver 44 drives the motor 43 according to the control signal CNT2.

The print signal SI is a digital signal for designating the type of operation of the ejection unit D. Specifically, the print signal SI designates the type of operation of the ejection unit D by designating whether to supply the drive signal Com to the ejection unit D. Here, designating the type of operation of the ejection unit D refers to, for example, designating whether to drive the ejection unit D, designating whether ink is ejected from the ejection unit D when the ejection unit D is driven, and designating the amount of ink ejected from the ejection unit D when the ejection unit D is driven.

The latch signal LAT and the change signal CNG are used together with the print signal SI to define the ejection timing of ink from the ejection unit D. The timing of the pulses included in these signals is set, based on the output of the encoder 37 described above, for example, to a timing synchronized with the operation of the carriage 20.

A1-3. Schematic Configuration of Ejection Unit D

Figure 3:
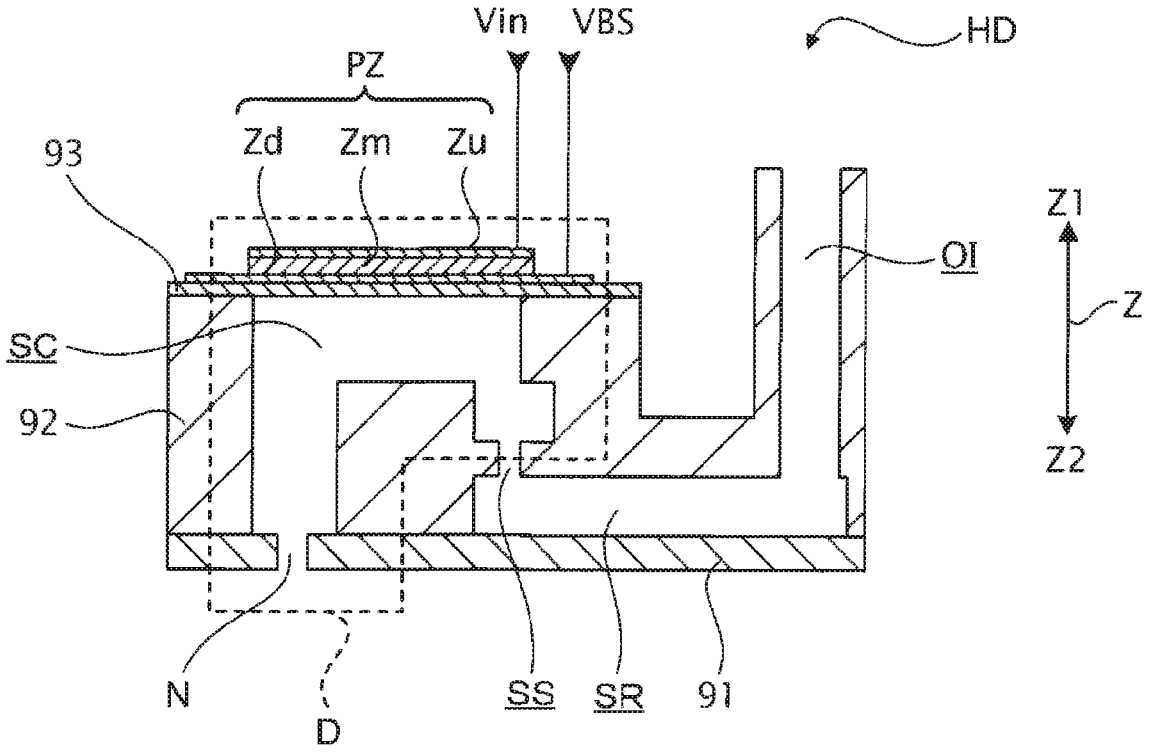
FIG. 3 is a cross-sectional view showing a schematic configuration of a recording head including an ejection unit.

FIG. 3 is a sectional view showing a schematic configuration of the recording head HD including the ejection unit D. As shown in FIG. 3, the recording head HD includes a nozzle plate 91, a flow path substrate 92, a vibration plate 93, and a plurality of piezoelectric elements PZ. These components are laminated in order of the nozzle plate 91, the flow path substrate 92, the vibration plate 93, and the plurality of piezoelectric elements PZ.

The nozzle plate 91 includes a plurality of nozzles N disposed in a predetermined direction. Each of the plurality of nozzles N is a through hole through which ink passes. The flow path substrate 92 includes a plurality of cavities SC, a reservoir SRV, a plurality of ink supply paths SS, and an ink introduction port CI. The cavity SC is a space individually provided for each nozzle N and communicating with the nozzle N. The reservoir SRV is a space provided in common to the plurality of nozzles N and extending in a direction of the arrangement of the plurality of nozzles N. The plurality of ink supply paths SS is a space provided for each nozzle N and coupling the plurality of cavities SC and the reservoir SRV. The ink introduction port OI is an opening for introducing the ink from the ink cartridge C into the reservoir SRV. The vibration plate 93 constitutes part of the wall face of each of the plurality of cavities SC, and is a plate-like member, for each cavity SC, that is elastically deformable in a direction in which the volume of the cavity SC is changed.

In the example shown in FIG. 3, each of the plurality of piezoelectric elements PZ is a unimorph (monomorph) type piezoelectric element. Specifically, each of the plurality of piezoelectric elements PZ includes an upper electrode Zu, a piezoelectric body Zm, and a lower electrode Zd. These components are laminated in this order. The offset potential VBS from the power supply circuit 53 described above is supplied to the lower electrode Zd. The supply drive signal Vin composed of part or all of the waveform included in the drive signal Com from the drive signal generation circuit 54 described above is supplied to the upper electrode Zu. When a voltage based on the potential difference between the offset potential VBS and the supply drive signal Vin as described above is applied between the upper electrode Zu and the lower electrode Zd, the piezoelectric element PZ vibrates the vibration plate 93 in the Z1 direction or the Z2 direction due to the inverse piezoelectric effect of the piezoelectric body Zm. Due to this vibration, the pressure in the cavity SC changes as the volume of the cavity SC changes, so that the ink is ejected from the nozzle N. The configuration of the piezoelectric element PZ is not limited to the unimorph type described above, and may be, for example, a bimorph type or a laminated type.

Of the components of the recording head HD described above, the aggregate of components provided for each nozzle N is the ejection unit D. Here, the ejection unit D includes the cavity SC, the piezoelectric element PZ, and the nozzle N.

A1-4. Electrical Configuration of Head Unit HU

Figure 4:
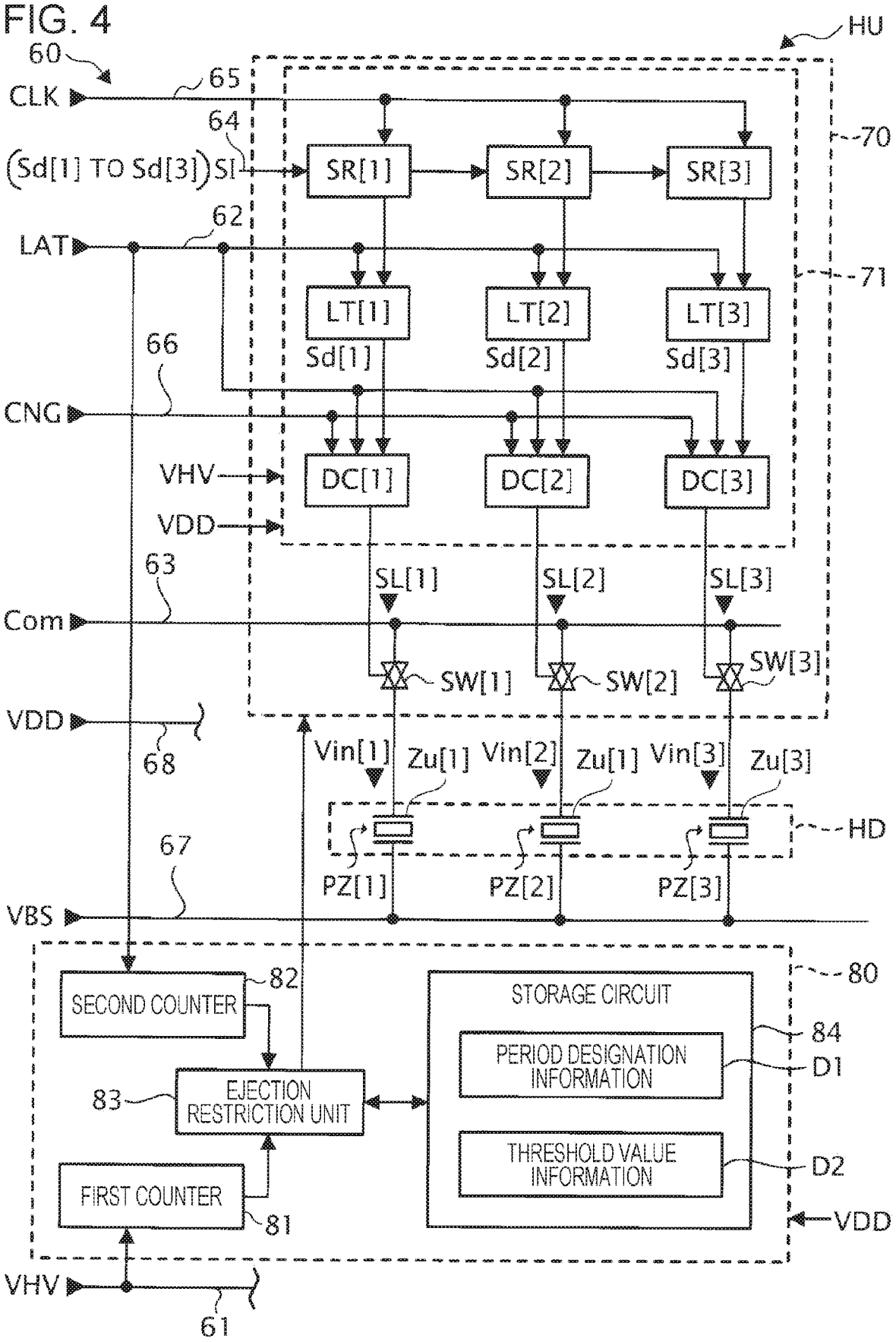
FIG. 4 is a diagram showing an electrical configuration of a liquid ejection head unit.

FIG. 4 is a diagram showing an electrical configuration of the head unit HU. As mentioned above, as shown in FIG. 4, the head unit HU is coupled to the cable 60, and the head unit HU includes the recording head HD, the supply circuit 70, and the restriction circuit 80.

The cable 60 includes a plurality of wires 61 to 68. The wire 61 is an example of the first wire. The wire 61 of the present embodiment is a high-potential-side power supply line to which the power supply potential VHV that is a fixed potential is supplied. The power supply potential VHV is used for driving the ejection unit D. The wire 62 is an example of the second wire. The wire 62 of the present embodiment is a signal line configured to transmit a LAT signal which is an example of the pulse signal that defines the ejection timing of ink in the ejection unit D. The wire 63 is a signal line configured to transmit the drive signal Com. The wire 64 is a signal line configured to transmit the print signal SI. The wire 65 is a signal line configured to transmit the clock signal CLK. The wire 66 is a signal line configured to transmit the change signal CNG. The wire 67 is a power supply line to which the offset potential VBS is supplied. The wire 68 is a low-potential-side power supply line to which the power supply potential VDD is supplied. The power supply potential VDD is used for driving various logic circuits in the head unit HU. Although not shown, the cable 60 includes, in addition to the above-described wires, a wire having a ground potential of 0 V used as a reference potential.

The supply circuit 70 includes M switches SW (SW[1] to SW[M]) and a coupling state designation circuit 71 that designates the coupling state of each switch SW. FIG. 4 shows the configuration of M=3 for convenience of description.

The switch SW[m] is a switch for switching conduction (ON) and nonconduction (OFF) between the wire 63 and the piezoelectric element PZ[m] in the transmission path of the drive signal Com from the drive signal generation circuit 54 to the piezoelectric element PZ[m]. Each switch SW is, for example, a transmission gate.

The coupling state designation circuit 71 generates, based on the clock signal CLK, the print signal SI, the latch signal LAT and the change signal CNG supplied from the control circuit 51, coupling state designation signals SL[1] to SL[M] for designating on/off of the switches SW[1] to SW[M]. Here, the latch signal LAT is an example of the pulse signal that defines the ejection timing of ink in the ejection unit D.

More specifically, the coupling state designation circuit 71 includes transfer circuits SR[1] to SR[M], latch circuits LT[1] to LT[M], and decoders DC[1] to DC[M] in one-to-one correspondence with the ejection units D[1] to D[M]. Of these, the print signal SI is supplied to the transfer circuit SR[m] via the wire 64. Here, the print signal SI includes an individual designation signal Sd[m] described later. The example shown in FIG. 4 shows that individual designation signals Sd[1] to Sd[M] are serially supplied, and for example, the individual designation signal Sd[m] is sequentially transferred from the transfer circuit SR[1] to the transfer circuit SR[m] in synchronization with the clock signal CLK from the wire 65. Further, the latch circuit LT[m] latches the individual designation signal Sd[m] supplied to the transfer circuit SR[m] at the timing when a pulse PlsL of the latch signal LAT from the wire 62 rises to the high level. The decoder DC[m] also generates the coupling state designation signal SL[m] based on the individual designation signal Sd[m], the latch signal LAT, and the change signal CNG. Here, the power supply potential VHV is also used to generate the coupling state designation signal SL[m] in the decoder DC[m].

The switch SW[m] is turned on/off according to the coupling state designation signal SL[m] generated as described above. For example, the switch SW[m] is turned on when the coupling state designation signal SL[m] is at the high level, and is turned off when the coupling state designation signal SL[m] is at the low level. As mentioned above, the supply circuit 70 supplies, to one or more ejection units D selected from the plurality of ejection units D, part or all of the waveform included in the drive signal Com as the supply drive signal Vin.

The restriction circuit 80 restricts the ejection of ink from the recording head HD when the damage to the wire of the cable 60 is detected. Specifically, the restriction circuit 80 includes a first counter 81, a second counter 82, an ejection restriction unit 83, and a storage circuit 84.

The first counter 81 is a circuit whose count value changes based on the potential change in the wire 61. Therefore, the first counter 81 outputs a count value that changes each time the potential on the wire 61 falls below the lower limit value of the range allowed as the original power supply potential VHV. Specifically, the first counter 81 is electrically coupled to the wire 61, and outputs a count value that is counted up each time the potential on the wire 61 is less than a predetermined first count threshold value. The first count threshold value is the above-described lower limit value or a value lower than the lower limit value, and is appropriately set to an any value between 0 V and the set value of the power supply potential VHV, for example. Note that the first counter 81 may output a count value that counts down each time the potential on the wire 61 is less than the first count threshold value.

The second counter 82 is a circuit whose count value changes based on the potential change in the wire 62. Therefore, the second counter 82 outputs a count value that changes according to the number of pulses of the latch signal LAT. Specifically, the second counter 82 is electrically coupled to the wire 62, and outputs a count value that is counted up each time the potential on the wire 62 exceeds a predetermined second count threshold value. The second count threshold value is appropriately set to, for example, an any value between the high level and the low level in the latch signal LAT. Here, the second counter 82 counts the number of rising edges of the pulse in the latch signal LAT. The second counter 82 may count the number of falling edges of the pulse in the latch signal LAT. The second counter 82 may output a count value that counts down each time the potential on the wire 62 exceeds the second count threshold value.

The ejection restriction unit 83 is a circuit that restricts the ejection operation of ink in the ejection unit D based on the count value of the first counter 81 and the count value of the second counter 82. As described in detail later, the ejection restriction unit 83 of this embodiment restricts the ejection operation of ink in the ejection unit D based on the ratio between the amount of change in the count value of the first counter 81 and the amount of change in the count value of the second counter 82 in a determination period Td, which is a predetermined period. When the ratio satisfies the predetermined condition, the ejection restriction unit 83 stops the operation of the coupling state designation circuit 71 described above, for example, so as to keep the switch SW[m] off. The ejection restriction unit 83 may include a programmable logic device such as the FPGA.

The storage circuit 84 is a circuit that stores information necessary for the operation of the ejection restriction unit 83. The storage circuit 84 includes, for example, a semiconductor memory. The storage circuit 84 of this embodiment stores period designation information D1 and threshold value information D2. The period designation information D1 is information for designating the determination period Td in the ejection restriction unit 83. The period designation information D1 of the present embodiment is information about the count value of the second counter 82. The threshold value information D2 is information about a threshold value serving as a reference for determining whether the wire 61 is damaged. The threshold value information D2 of the present embodiment is information about the count value of the first counter 81. In addition, part or all of the storage circuit 84 may be included in the ejection restriction unit 83.

A1-5. Operation of Head Unit HU

Figure 5:
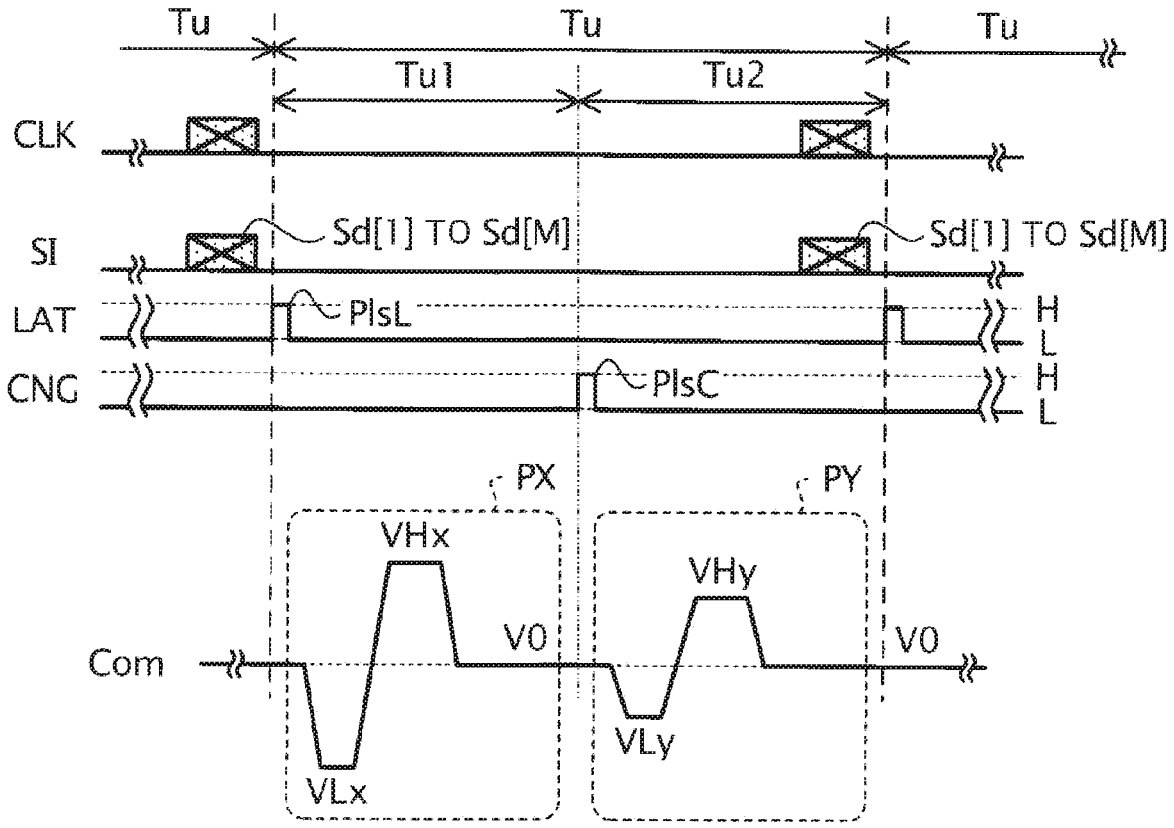
FIG. 5 is a timing chart for explaining an example of the operation of the liquid ejection head unit.

FIG. 5 is a timing chart for explaining an example of the operation of the head unit HU. As shown in FIG. 5, the latch signal LAT includes the pulse PlsL for defining a unit period Tu. The unit period Tu is defined, for example, as a period from the rise of the pulse PlsL to the rise of the next pulse PlsL. The change signal CNG includes a pulse PlsC for dividing the unit period Tu into a control period Tu1 and a control period Tu2. The control period Tu1 is, for example, a period from the rise of the pulse PlsL to the rise of the pulse PlsC. The control period Tu2 is, for example, a period from the rise of the pulse PlsC to the rise of the pulse PlsL.

The print signal SI also includes individual designation signals Sd[1] to Sd[M] that designate the types of operations of the ejection units D[1] to D[M] in each unit period Tu. The individual designation signals Sd[1] to Sd[M] are supplied to a coupling state designation circuit 11 in synchronization with the clock signal CLK as described above, prior to the unit period Tu. The coupling state designation circuit 11 generates the coupling state designation signal SL[m] based on the individual designation signal Sd[m] in the unit period Tu.

As shown in FIG. 5, the drive signal Com has a waveform PX provided in the control period Tu1 and a waveform PY provided in the control period Tu2. In the example shown in FIG. 5, the potential difference between a highest potential VHX and a lowest potential VLX in the waveform PX is larger than the potential difference between a highest potential VHY and a lowest potential VLY in the waveform PY.

When the individual designation signal Sd[m] is a value designating the formation of a medium dot, the coupling state designation signal SL[m] is at the high level in the control period Tu1 and is at the low level in the control period Tu2. Therefore, only the waveform PX of the drive signal Com is supplied to the ejection unit D as the supply drive signal Vin. As a result, the ejection unit D ejects an amount of ink corresponding to a medium dot.

When the individual designation signal Sd[m] is a value designating the formation of small dots, the coupling state designation signal SL[m] is at the low level in the control period Tu1 and is at the high level in the control period Tu2. Therefore, only the waveform PY of the drive signal Com is supplied to the ejection unit D as the supply drive signal Vin. As a result, the ejection unit D ejects an amount of ink corresponding to a small dot.

When the individual designation signal Sd[m] has a value designating the formation of a large dot, the coupling state designation signal SL[m] is at the high level in both the control periods Tu1 and Tu2. Therefore, the waveforms PX and PY in the drive signal Com are supplied to the ejection unit D as the supply drive signal Vin. As a result, the ejection unit D ejects an amount of ink corresponding to a large dot.

When the individual designation signal Sd[m] has a value designating non-ejection of ink, the coupling state designation signal SL[m] is at the low level in both the control periods Tu1 and Tu2. Therefore, neither of the waveforms PX and PY in the drive signal Com is supplied to the ejection unit D. As a result, no ink is ejected from the ejection unit D.

A1-6. Operation of Ejection Restriction Unit 83

Figure 6:
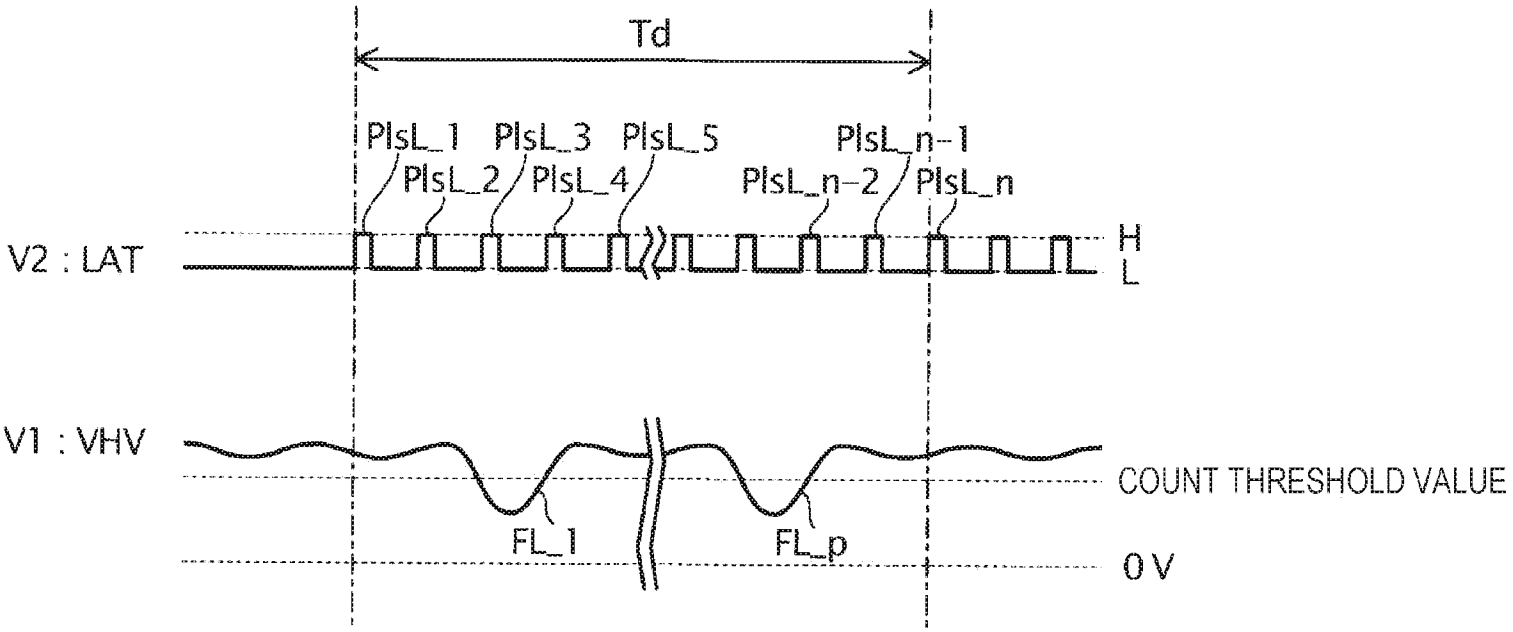
FIG. 6 is a diagram for explaining a determination period of an ejection restriction unit in the first embodiment.

FIG. 6 is a diagram for explaining the determination period Td of the ejection restriction unit 83 in the first embodiment. FIG. 6 illustrates the relationship between the potential V1 of the wire 61, the potential V2 of the wire 62, and the determination period Td. The ejection restriction unit 83 restricts the ejection operation of ink in the ejection unit D based on the ratio between the amount of change in the count value of the first counter 81 and the amount of change in the count value of the second counter 82 in the determination period Td.

As shown in FIG. 6, the determination period Td of the present embodiment is defined by the number of pulses PlsL of the latch signal LAT. FIG. 6 shows the determination period Td is defined by n pulses PlsL_1 to PlsL_n. In the present embodiment, n is a natural number of 2 or more. As described above, the determination period Td in the present embodiment is a period in which the amount of change in the count value of the second counter 82 is the predetermined amount n.

FIG. 6 illustrates the potential V1 has p fluctuations FL_1 to FL_p with a potential lower than the first count threshold value of the first counter 81 in the determination period Td.

The larger the amount of change in the count value of the first counter 81 in the determination period Td, the higher the possibility that the wire 61 is damaged.

Here, the count value of the first counter 81 not only changes when the wire 61 is damaged, but also changes when the voltage value of the commercial power supply fluctuates. Therefore, when damage to the wire 61 is detected simply based on the count value of the first counter 81, an erroneous detection will occur when the voltage value of the commercial power supply fluctuates.

Examples of the damage state of the wire 61 include a state in which part of the wire 61 is missing, a state in which portions of the wire 61 that are separated by a break can contact each other, and the like. When the wire 61 or 62 is completely broken, since the electric power or the signal necessary for the ejection unit D is not supplied, the ink cannot be ejected from the ejection unit D.

On the other hand, the count value of the second counter 82 outputs a count value that changes based on the change in displacement of the wire 62 included in the cable 60 which includes the wire 61. For this reason, even when the count value of the first counter 81 changes, the wire 62 is not damaged when the count value of the second counter 82 changes, so that it can be estimated that the wire 61 is not damaged. Here, since the latch signal LAT has a potential extremely lower than the power supply potential VHV, the latch signal LAT is generated with almost no problem under the condition of fluctuations of the voltage value of the commercial power supply. In contrast, when the count value of the first counter 81 changes, and when the count value of the second counter 82 does not change, it is highly possible that the wire 62 is damaged, and it can be estimated that the wire 61 is damaged.

Therefore, the ejection restriction unit 83 determines whether the amount of change in the count value of the first counter 81 in the determination period Td exceeds the threshold value. The ejection restriction unit 83 of the present embodiment makes this determination when the count value of the second counter 82 reaches a predetermined value. Then, when the amount of change in the count value of the first counter 81 in the determination period Td exceeds the threshold value, the ejection restriction unit 83 restricts the ejection operation of ink in the ejection unit D. On the other hand, when the amount of change in the count value of the first counter 81 in the determination period Td is less than or equal to the threshold value, the ejection restriction unit 83 does not restrict the ejection operation of ink in the ejection unit D.

From the viewpoint of accurately determining the damage of the wire 61, the above-mentioned predetermined value, that is, the number n, of the pulses PlsL, that defines the determination period Td is preferably in the range of 100 or more and 10000 or less, more preferably in the range of 500 or more and 3000 or less, and still more preferably in the range of 700 or more and 2000 or less. On the other hand, when the number n is too small or too large, there is a tendency that an erroneous detection of damage to the wire 61 is likely to occur.

From the same viewpoint, the above-mentioned threshold value, that is, the number p at which it is determined that the wire 61 is damaged is preferably 2 or more, and preferably in the range of 2 or more and 5 or less.

Figure 7:
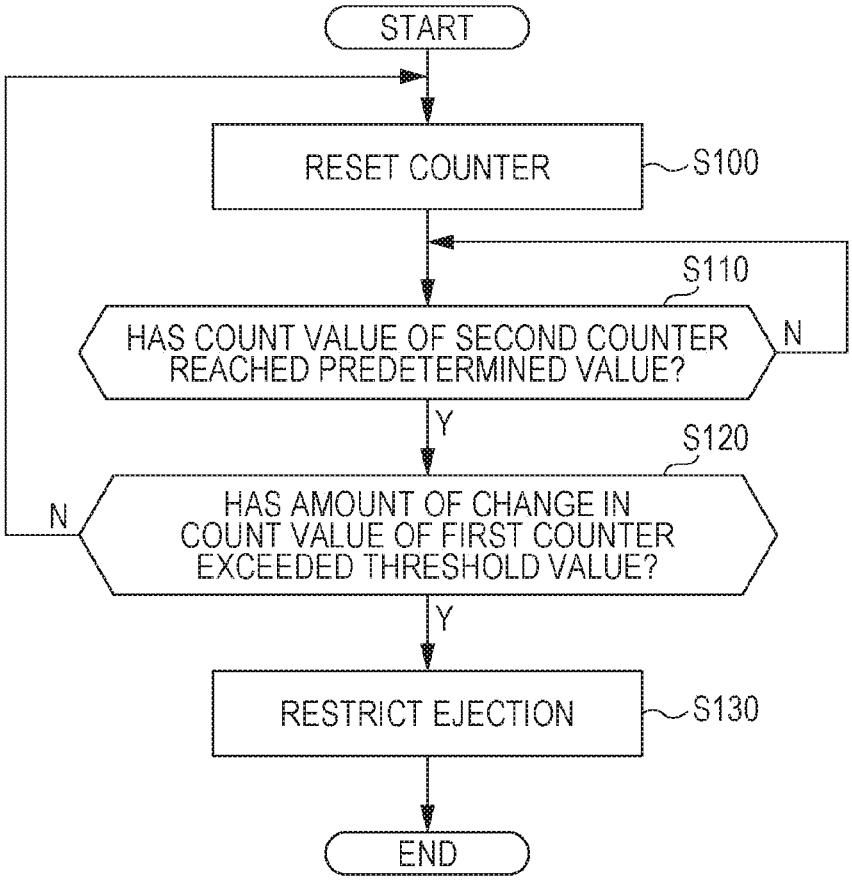
FIG. 7 is a flowchart for explaining the operation of the ejection restriction unit in the first embodiment.

FIG. 7 is a flowchart for explaining the operation of the ejection restriction unit 83 in the first embodiment. As shown in FIG. 7, first, in step S100, the ejection restriction unit 83 resets the first counter 81 and the second counter 82. Next, in step S110, the ejection restriction unit 83 determines whether the count value of the second counter 82 reaches a predetermined value based on the period designation information D1 described above. The step S110 is repeated until the count value of the second counter 82 reaches the predetermined value.

When the count value of the second counter 82 reaches the predetermined value, the ejection restriction unit 83 determines in step S120 whether the count value of the first counter 81 exceeds the threshold value based on the threshold value information D2 described above. When the count value of the first counter 81 is less than or equal to the threshold value, the process returns to step S100 described above. On the other hand, when the count value of the first counter 81 exceeds the threshold value, the ejection restriction unit 83 restricts the ejection operation of ink in the ejection unit D in step S130.

As described above, the liquid ejecting apparatus 1 includes the power supply circuit 53 and the head unit HU which is an example of the liquid ejection head unit. Here, the head unit HU includes the ejection unit D, the wire 61 which is an example of the first wire, the wire 62 which is an example of the second wire, the first counter 81, the second counter 82, and the ejection restriction unit 83.

In the head unit HU, the ejection unit D ejects ink, which is an example of a liquid. The wire 61 is a wire configured to supply the power supply potential VHV, which is an example of the fixed potential used for driving the ejection unit D. The power supply potential VHV is supplied to the wire 61 using electric power supplied from a commercial power supply (not shown). The wire 62 transmits the latch signal LAT which is an example of the pulse signal that defines the ink ejection timing in the ejection unit D. The count value of the first counter 81 changes according to the potential change in the wire 61. The count value of the second counter 82 changes according to the potential change in the wire 62. The ejection restriction unit 83 restricts the ejection operation of ink in the ejection unit D according to the count value of the first counter 81 and the count value of the second counter 82.

For this reason, the configuration of the present disclosure makes it possible to detect the wire damage of the wire 61 with high accuracy and restrict the ejection operation of ink in the ejection unit D, compared with the configuration in the related art in which the ejection operation of a liquid in the ejection unit D is restricted simply based on the count value of the first counter 81. That is, the fluctuation of the voltage value of the commercial power supply is erroneously detected as the damage of the wire 61 in the configuration in the related art, and based on the false detection, the ejection operation of ink in the ejection unit D is unnecessarily restricted. In the head unit HU, unnecessary restriction of the ejection operation of ink in the ejection unit D based on the erroneous detection is reduced, unlike the configuration in the related art.

Further, since the existing latch signal LAT as the pulse signal that defines the ink ejection timing in the ejection unit D is used, the circuit configuration of the ejection restriction unit 83 is rarely complicated, compared with the configuration in the related art. Further, the latch signal LAT is less likely to be affected by fluctuations in the voltage value of the commercial power supply than the power supply potential VHV. Therefore, the state of the potential fluctuation of the power supply potential VHV can be detected with high accuracy with the potential fluctuation of the latch signal LAT as a reference. As a result, erroneous detection of fluctuations in the voltage value of the commercial power supply as damage to the wire 61 is effectively reduced.

The head unit HU of this embodiment is mounted on a serial printer for use. That is, the liquid ejecting apparatus 1 includes the housing 10 to which the power supply circuit 53 is fixed, the carriage 20 that reciprocates in a predetermined direction with respect to the housing 10, and the cable 60 which is a flexible flat cable for coupling the power supply circuit 53 and the carriage 20. Here, the ejection unit D is mounted on the carriage 20. The cable 60 includes the wires 61 and 62. For this reason, when the reciprocating movement of the carriage 20 with respect to the housing 10 is repeated, the wire 61 included in the cable 60 is repeatedly deformed, so that the risk of damage to the wire 61 increases. Therefore, when the head unit HU is mounted on the serial printer, it is useful to restrict the operation of the ejection unit D when the damage of the wire 61 is detected.

A2. Second Embodiment

Figure 8:
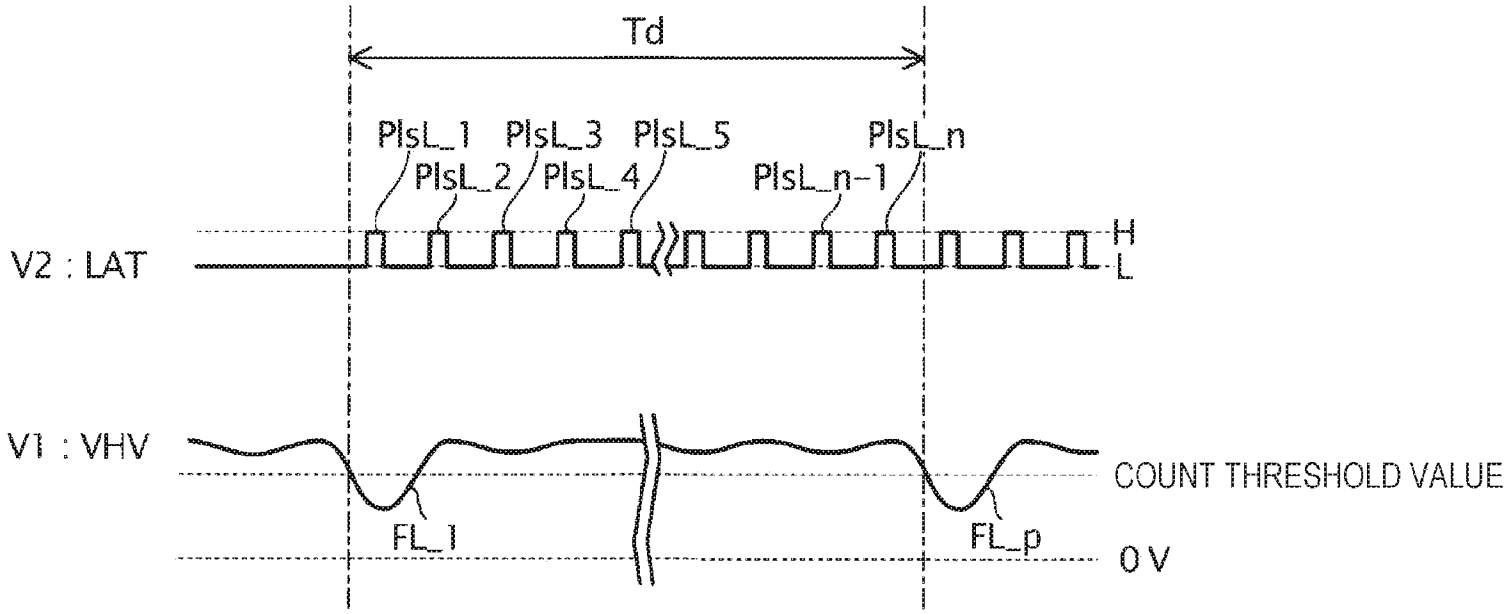
FIG. 8 is a diagram for explaining a determination period of an ejection restriction unit in a second embodiment.

FIG. 8 is a diagram for explaining the determination period Td of the ejection restriction unit 83 in the second embodiment. As shown in FIG. 8, the ejection restriction unit 83 of the second embodiment defines the determination period td by the count value of the first counter 81, and according to whether the count value of the second counter 82 is less than the threshold value, determines whether the ratio between these count values in the determination period td satisfies a predetermined condition. The period designation information D1 of the present embodiment is information about the count value of the first counter 81. The threshold value information D2 of this embodiment is information about the count value of the second counter 82.

As shown in FIG. 8, the determination period Td of the present embodiment is defined by the number p of fluctuations FL of the power supply potential VHV. FIG. 8 shows the determination period Td is defined by p fluctuations FL_1 to FL_p. As described above, the determination period Td in the present embodiment is a period in which the amount of change in the count value of the first counter 81 is the predetermined amount p.

When the count value of the first counter 81 reaches a predetermined value, the ejection restriction unit 83 of the present embodiment determines whether the amount of change in the count value of the second counter 82 in the determination period Td is less than the threshold value. When the amount of change in the count value of the second counter 82 in the determination period Td is less than the threshold value, the ejection restriction unit 83 restricts the ejection operation of ink in the ejection unit D. On the other hand, when the amount of change in the count value of the second counter 82 in the determination period Td is greater than or equal to the threshold value, the ejection restriction unit 83 does not restrict the ejection operation of ink in the ejection unit D.

From the viewpoint of accurately determining the damage to the wire 61, it is preferable that the above-described predetermined value, that is, the number p of fluctuations FL that defines the determination period Td is within a range of 2 or more and 5 or less. Also, from a similar perspective, the above-mentioned threshold value, that is, the number n at which it is determined that the wire 61 is damaged is preferably in the range of 100 or more and 10000 or less, more preferably in the range of 500 or more and 3000 or less, still more preferably in the range of 700 or more and 2000 or less.

Figure 9:
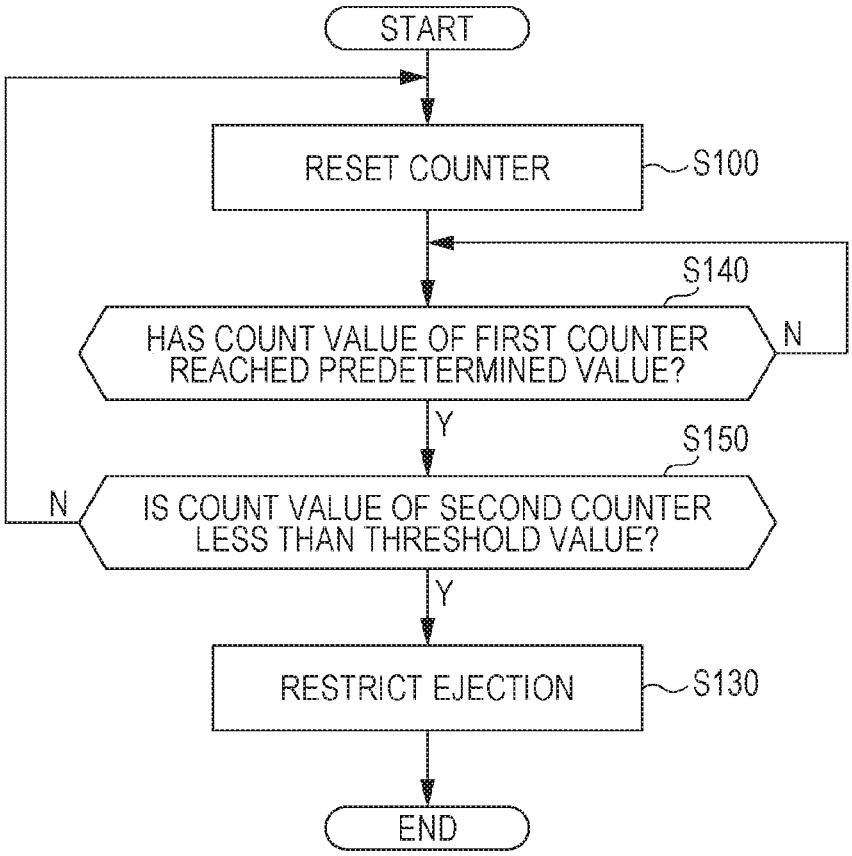
FIG. 9 is a flowchart for explaining the operation of the ejection restriction unit in the second embodiment.

FIG. 9 is a flowchart for explaining the operation of the ejection restriction unit 83 in the second embodiment. As shown in FIG. 9, first, in step S100, the ejection restriction unit 83 resets the first counter 81 and the second counter 82. Next, in step S140, the ejection restriction unit 83 determines whether the count value of the first counter 81 reaches a predetermined value based on the period designation information D1 described above. The step S140 is repeated until the count value of the first counter 81 reaches the predetermined value.

When the count value of the first counter 81 reaches the predetermined value, the ejection restriction unit 83 determines in step S150 whether the count value of the second counter 82 is less than the threshold value based on the threshold value information D2 described above. When the count value of the second counter 82 is greater than or equal to the threshold value, the process returns to step S100 described above. On the other hand, when the count value of the second counter 82 is less than the threshold value, the ejection restriction unit 83 restricts the ejection operation of ink in the ejection unit D in step S130.

The above second embodiment can have the same effect as the above first embodiment. Since the number of fluctuations FL in the determination period Td is constant, the embodiment has an advantage that the driving of the ejection unit D in the state of the unstable power supply potential VHV is reduced, compared with the first embodiment described above. Further, reducing the driving of the ejection unit D in the state of the unstable power supply potential VHV contributes to reducing the risk of failure of the head unit HU.

B. Modification

The above-described embodiments can be variously modified. Modes of specific modifications are exemplified below. Two or more modes optionally selected from the following exemplifications can be appropriately merged within a range not inconsistent with each other. In the modifications illustrated below, elements having the same actions and functions as those of the embodiments will be denoted by the reference numerals used in the above description, and detailed description thereof will be appropriately omitted.

B1. First Modification

The determination period Td in each of the above-described embodiments is not limited to the period based on the count value of the first counter 81 or the second counter 82, but for example, it may be a period for the predetermined number of pulses of the clock signal CLK.

Figure 10:
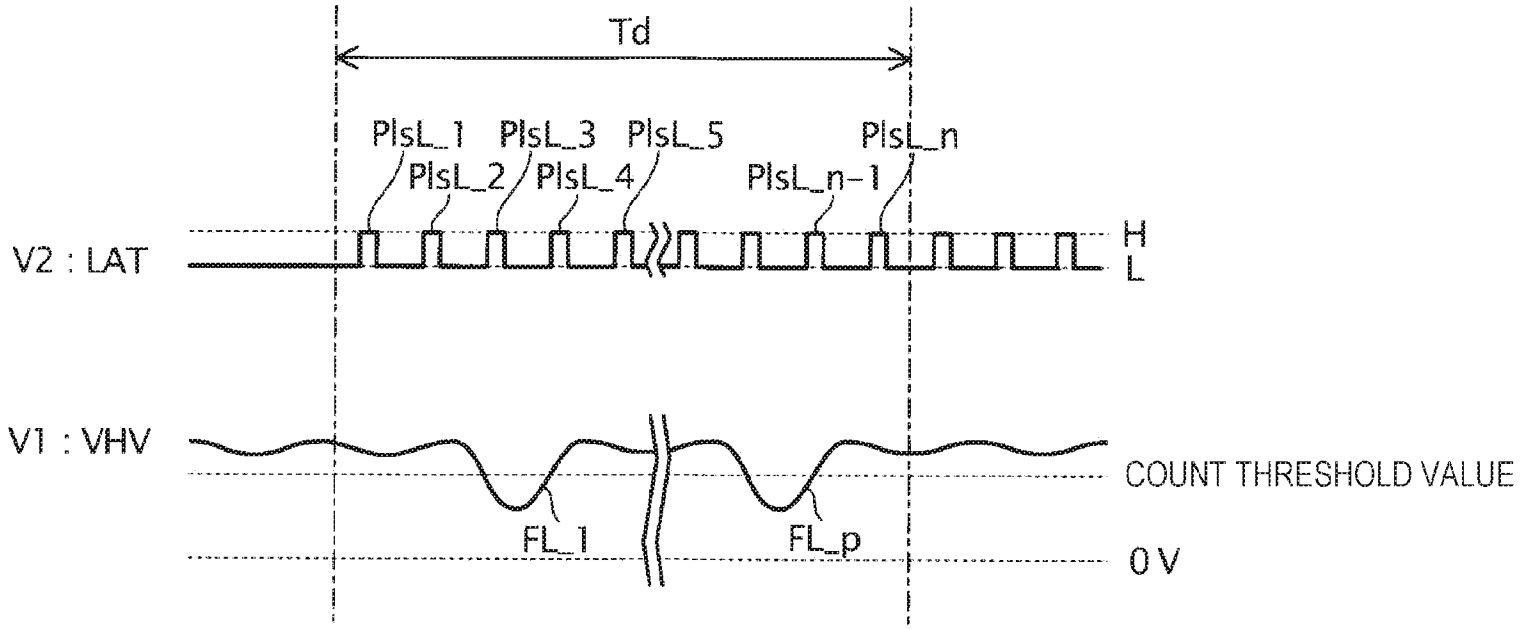
FIG. 10 is a diagram for explaining a determination period of an ejection restriction unit in a first modification.

FIG. 10 is a diagram for explaining the determination period Td of the ejection restriction unit 83 in the first modification. In the first modification, as shown in FIG. 10, the determination period Td is a preset fixed period. The determination period Td in the first modification is defined by the number of pulses of the clock signal CLK, for example. The ejection restriction unit 83 of the modification 1 determines, for the determination period Td, whether the ratio between the count value of the first counter 81 and the count value of the second counter 82 in the determination period Td satisfies a predetermined condition. The period designation information D1 of this embodiment is information about the number of pulses of the clock signal CLK. The threshold value information D2 of the present embodiment is information about the ratio between the count value of the first counter 81 and the count value of the second counter 82.

Figure 11:
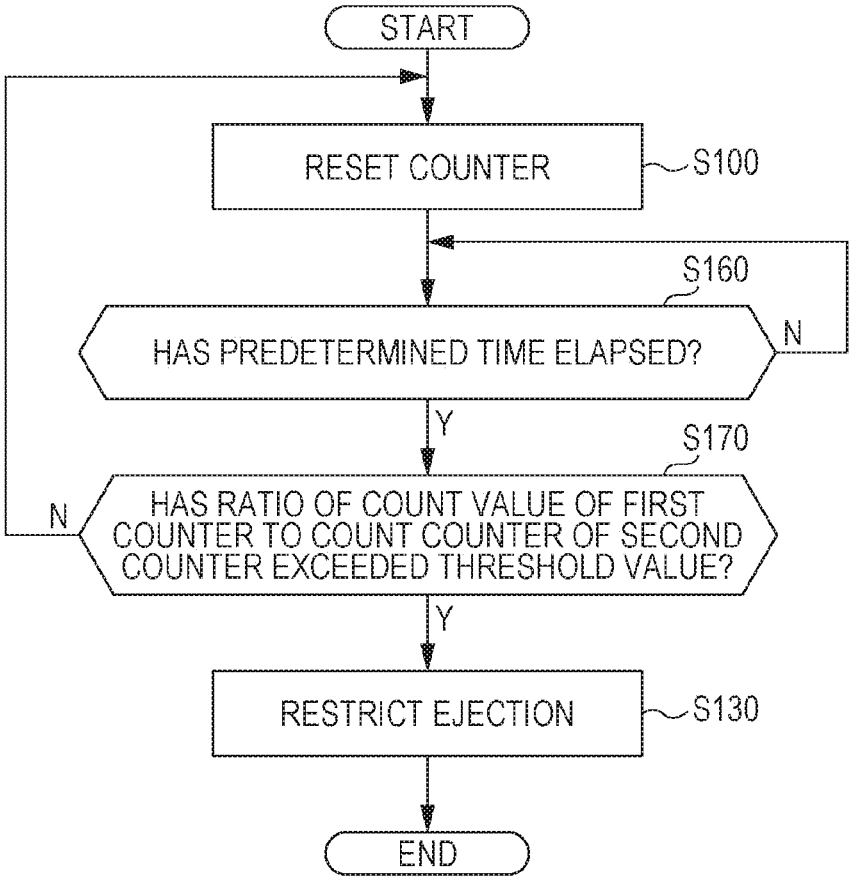
FIG. 11 is a timing chart for explaining the operation of the ejection restriction unit in the first modification.

FIG. 11 is a flowchart for explaining the operation of the ejection restriction unit 83 in the first modification. As shown in FIG. 11, first, in step S100, the ejection restriction unit 83 resets the first counter 81 and the second counter 82. Next, in step S160, the ejection restriction unit 83 determines whether a predetermined time has elapsed based on the predetermined number of pulses of the clock signal CLK. The step S160 is repeated until the predetermined time elapses.

When the predetermined time has passed, the ejection restriction unit 83 determines in step S170 whether the ratio of the count value of the first counter 81 to the count value of the second counter 82 in the period of the predetermined time exceeds the threshold value based on the threshold value information D2 described above. When the ratio is less than or equal to the threshold value, the process returns to the above-mentioned step S100. On the other hand, when the ratio exceeds the threshold value, the ejection restriction unit 83 restricts the ejection operation of ink in the ejection unit D in step S130.

B2. Second Modification

The fixed potential supplied to the first wire is not limited to the power supply potential VHV but may be, for example, the offset potential VBS or the like. Further, the pulse signal transmitted to the second wire is not limited to the latch signal LAT, but may be, for example, the print signal SI, the clock signal CLK, the change signal CNG, or the like.

B3. Third Modification

In the above-described embodiments and modifications, the liquid ejecting apparatus 1 includes one drive signal generation circuit 54, and one head unit HU. The present disclosure is not limited to such a mode, and the liquid ejecting apparatus 1 may include the plurality of drive signal generation circuits 54 and the plurality of head units HU.

B4. Fourth Modification

In the above-described embodiments and modifications, it is assumed that the liquid ejecting apparatus 1 is a serial printer. The present disclosure is not limited to such a mode, and the liquid ejecting apparatus 1 may be a so-called line printer in which the plurality of nozzles N of the recording head HD is provided so as to extend wider than the width of the print medium P.

What is claimed is:

1. A liquid ejection head unit comprising:

an ejection unit that ejects a liquid, a first wire configured to supply a fixed potential used for an operation of the ejection unit;

a second wire configured to transmit a pulse signal that defines an ejection timing of the liquid in the ejection unit;

a first counter whose count value changes based on a potential change in the first wire;

a second counter whose count value changes based on a potential change in the second wire; and an ejection restriction unit that restricts an ejection operation of the liquid in the ejection unit based on a count value of the first counter and a count value of the second counter, the ejection restriction unit restricting, based on a ratio between an amount of change in a count value of the first counter and an amount of change in a count value of the second counter in a predetermined period, an ejection operation of a liquid in the ejection unit.

2. The liquid ejection head unit according to claim 1, wherein the pulse signal is a latch signal.

3. The liquid ejection head unit according to claim 1, wherein the predetermined period is a period in which an amount of change in a count value of the first counter is a predetermined amount, and wherein when an amount of change in a count value of the second counter in the predetermined period is less than a threshold value, the ejection restriction unit restricts an ejection operation of a liquid in the ejection unit.

4. The liquid ejection head unit according to claim 3, wherein when a count value of the first counter reaches a predetermined value, the ejection restriction unit determines whether an amount of change in a count value of the second counter in the predetermined period is less than a threshold value.

5. The liquid ejection head unit according to claim 1, wherein the predetermined period is a period in which an amount of change in a count value of the second counter is a predetermined amount, and wherein when an amount of change in a count value of the first counter in the predetermined period exceeds a threshold value, the ejection restriction unit restricts an ejection operation of a liquid in the ejection unit.

6. The liquid ejection head unit according to claim 5, wherein when a count value of the second counter reaches a predetermined value, the ejection restriction unit determines whether the amount of change in the count value of the first counter in the predetermined period exceeds a threshold value.

7. The liquid ejection head unit according to claim 1 that is mounted in a serial printer for use.

8. A liquid ejecting apparatus comprising:

an ejection unit that ejects a liquid;

a first wire configured to supply a fixed potential used for driving the ejection unit a power supply circuit that supplies the fixed potential to the first wire using electric power supplied from a commercial power supply;

a second wire configured to transmit a pulse signal that defines an ejection timing of a liquid in the ejection unit;

a first counter whose count value changes according to a potential change in the first wire;

a second counter whose count value changes according to a potential change in the second wire; and an ejection restriction unit that restricts an ejection operation of the liquid in the ejection unit according to a count value of the first counter and a count value of the second counter, the ejection restriction unit restricting, based on a ratio between an amount of change in a count value of the first counter and an amount of change in a count value of the second counter in a predetermined period, an ejection operation of a liquid in the ejection unit.

9. The liquid ejecting apparatus according to claim 8, wherein the pulse signal is a latch signal.

10. The liquid ejecting apparatus according to claim 8, wherein the predetermined period is a period in which an amount of change in a count value of the first counter is a predetermined amount, and wherein when an amount of change in a count value of the second counter in the predetermined period is less than a threshold value, the ejection restriction unit restricts an ejection operation of a liquid in the ejection unit.

11. The liquid ejecting apparatus according to claim 10, wherein when a count value of the first counter reaches a predetermined value, the ejection restriction unit determines whether an amount of change in a count value of the second counter in the predetermined period is less than a threshold value.

12. The liquid ejecting apparatus according to claim 8, wherein the predetermined period is a period in which an amount of change in a count value of the second counter is a predetermined amount, and wherein when an amount of change in a count value of the first counter in the predetermined period exceeds a threshold value, the ejection restriction unit restricts an ejection operation of a liquid in the ejection unit.

13. The liquid ejecting apparatus according to claim 12, wherein when a count value of the second counter reaches a predetermined value, the ejection restriction unit determines whether the amount of change in the count value of the first counter in the predetermined period exceeds a threshold value.

14. The liquid ejecting apparatus according to claim 8, further comprising:

a housing to which the power supply circuit is fixed;

a carriage on which the ejection unit is mounted and which reciprocates in a predetermined direction with respect to the housing; and a flexible flat cable including the first wire and the second wire, the flexible flat cable being configured to couple the power supply circuit and the carriage.

* * * * *